US010723149B2

(12) United States Patent
Winburne et al.

(10) Patent No.: US 10,723,149 B2
(45) Date of Patent: Jul. 28, 2020

(54) INITIATING A SHORTAGE MODEL

(71) Applicant: Hewlett-Packard Development Company, L.P., Houston, TX (US)

(72) Inventors: Robert Lawrence Winburne, Vancouver, WA (US); Jason M. Quintana, Vancouver, WA (US); Donnell D. Daniels, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/351,950

(22) Filed: Mar. 13, 2019

(65) Prior Publication Data

US 2019/0210381 A1 Jul. 11, 2019

Related U.S. Application Data

(63) Continuation of application No. 15/748,021, filed as application No. PCT/US2015/067114 on Dec. 21, 2015, now Pat. No. 10,272,699.

(51) Int. Cl.

| | |
|---|---|
| ***B41J 11/00*** | (2006.01) |
| ***B41J 29/38*** | (2006.01) |
| ***B41J 13/00*** | (2006.01) |

(52) U.S. Cl.

CPC ..... *B41J 11/0065* (2013.01); *B41J 11/008* (2013.01); *B41J 11/0045* (2013.01); *B41J 13/0018* (2013.01); *B41J 29/38* (2013.01)

(58) Field of Classification Search

CPC B41J 11/0065; B41J 11/0045; B41J 13/0018; B41J 11/008; B41J 29/38

See application file for complete search history.

(56) References Cited

U.S. PATENT DOCUMENTS

| | | | |
|---|---|---|---|
| 5,620,174 | A | 4/1997 | Taniguro et al. |
| 6,126,347 | A | 10/2000 | Sakaino et al. |
| 6,139,140 | A | 10/2000 | Rasmussen |
| 6,565,190 | B1 | 5/2003 | Nobel et al. |
| 6,935,715 | B2 | 8/2005 | Bates et al. |
| 7,258,409 | B2 | 8/2007 | Kunihiro |
| 8,608,281 | B2 | 12/2013 | Ito |

(Continued)

FOREIGN PATENT DOCUMENTS

| | | |
|---|---|---|
| CN | 103092695 | 5/2003 |
| CN | 1640681 | 7/2005 |

(Continued)

OTHER PUBLICATIONS

IP.com search (Year: 2020).*
IP.com search (Year 2018).

*Primary Examiner* — Lisa Solomon
(74) *Attorney, Agent, or Firm* — Brooks Cameron & Huebsch PLLC

(57) ABSTRACT

Example implementations relate to initiation of a shortage model in a printing device. For example, initiation of a shortage model may include guidance of a page of print media through a printing device by a feedshaft and an upper paper guide, where the page of print media is held by a media control surface. A shortage model may be initiated based on an amount of data to be printed. An ink nozzle may be turned off based on the initiated shortage model.

20 Claims, 3 Drawing Sheets

(56) References Cited

U.S. PATENT DOCUMENTS

| | | | | |
|---|---|---|---|---|
| 8,641,160 | B2 | 2/2014 | Kinas et al. | |
| 8,991,966 | B2 * | 3/2015 | Arakane | B41J 13/0009 347/16 |
| 9,174,456 | B1 | 11/2015 | Inoue | |
| 2005/0157326 | A1 | 7/2005 | Lee | |
| 2010/0289841 | A1 | 11/2010 | Nakagawa et al. | |
| 2013/0307888 | A1 | 11/2013 | Matsuhashi | |
| 2014/0035985 | A1 | 2/2014 | Arakane et al. | |

FOREIGN PATENT DOCUMENTS

| | | |
|---|---|---|
| CN | 101739726 | 6/2010 |
| CN | 101885266 | 11/2010 |
| CN | 103342054 | 10/2013 |
| EP | 1388422 | 2/2004 |
| JP | 11138923 | 5/1999 |
| JP | 2008149533 | 7/2008 |
| JP | 2012161772 | 8/2012 |

* cited by examiner

INITIATING A SHORTAGE MODEL

PRIORITY INFORMATION

This application is a continuation of U.S. National Stage Application Ser. No. 15/748,021 filed on Jan. 26, 2018, which claims priority to Application No. PCT/US2015/067114 filed on Dec. 21, 2015, the contents of which are incorporated herein by reference in its entirety.

BACKGROUND

Many printers are required to print data within a specified set of margins. In these devices, multiple systems may work together to ensure that a printed page matches the data and specifications. Exact matches to the specification may be imperfect. Individual systems within the printer may be tuned or calibrated to improve the printer's ability to precisely match print specifications. Still, variations may occur when printing.

DETAILED DESCRIPTION

Figure 1:
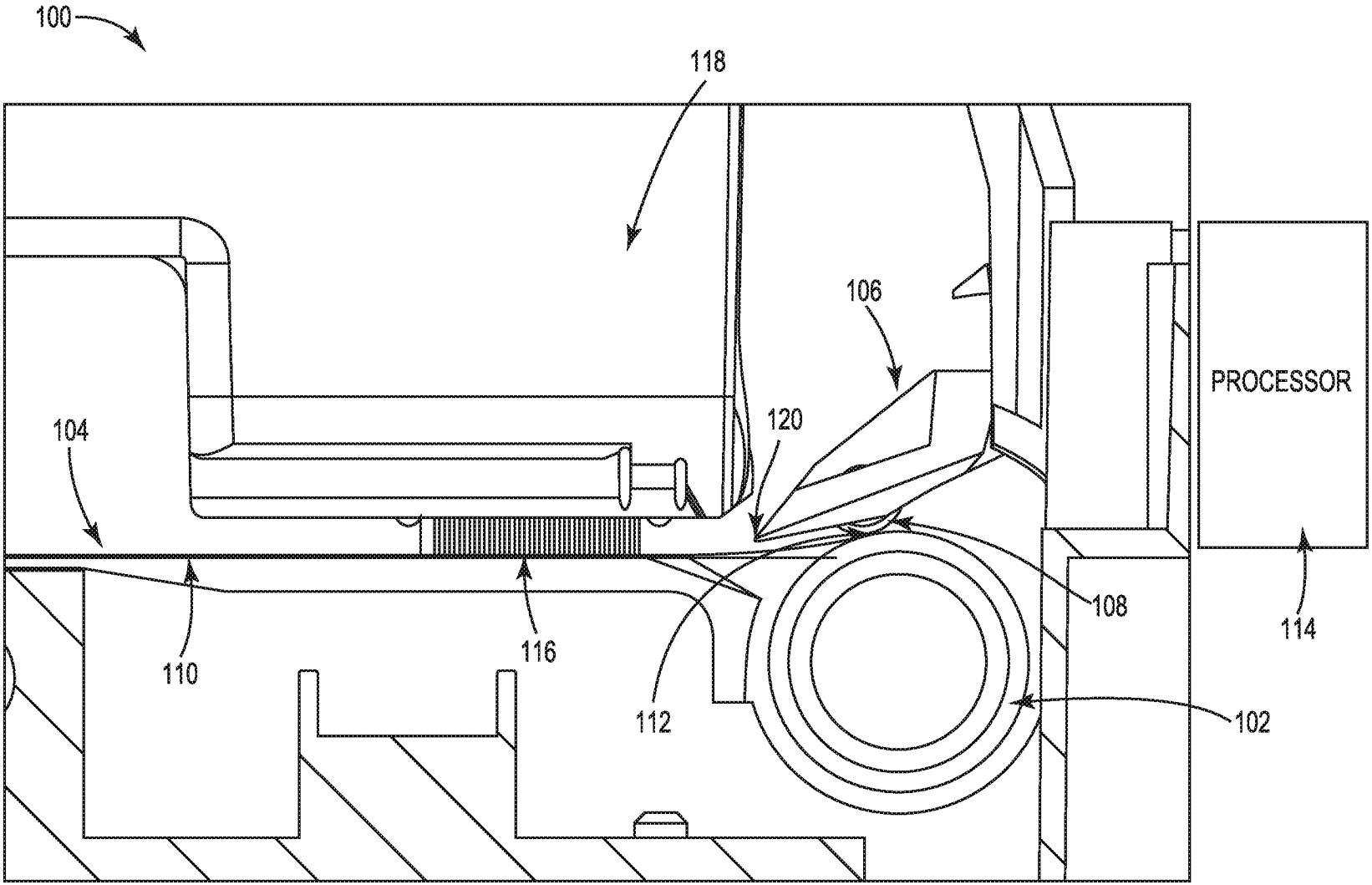
FIG. 1 illustrates an example system for initiating a shortage model according to the present disclosure.

Due to the geometry of ink cartridges and their close proximity to the print media when printing, there is a limit to the minimum bottom margin when using a single precision media drive system. As used herein, a media drive system refers to a plurality of mechanical components in a printing device to advance printing media through the printing device. In order to get around this limitation, some printers may include a secondary precision media drive system to take control of the media advances when the bottom of the media is being printed. In such devices, when printing at the bottom of the page, the print media may leave the primary media drive system in order to enter the print zone. During this time, all media advances may be controlled by the secondary media drive system. Without a secondary media drive system, the printer cannot print after the media leaves the primary media drive system. As such, these printers must have larger bottom margins.

In contrast, initiating a shortage model according to the present disclosure may allow particular ink nozzles within an ink nozzle array to be selected to print with precision near the bottom of the media. Put another way, by selectively printing with particular ink nozzles within an ink nozzle array, data may be printed near a bottom edge of a piece of media without losing data to be printed. Specifically, initiating a shortage model is described herein. As used herein, a shortage model refers to instructions that limit printing past the end of the print media for cases when the print media length does not match the data to be printed. In some printing devices, the shortage model may cut off all data that would have been printed after the media leaves the media drive system in order to ensure ink does not get sprayed onto the printer mechanism causing future print issues. For instance, if a user starts to print a legal document when using letter size media, the shortage model may remove the bottom portion of the data that would have been printed at the bottom of the legal document. This shortage model may cut the data in the most effective manner to minimize the lost data by using the furthest extent of the ink nozzles possible. Further, this shortage model may often be triggered by a mechanical switch that actuates when the bottom edge of the media travels past the switch.

Initiating a shortage model in other printing devices may include inherent variation associated with manufacturing tolerances, such as switching variation, media length variation, media advance variation, among other variances. Therefore, in order to ensure that no ink is placed on the media after the media leaves the drive system, the entire printing device must be tuned accordingly. However, modifying the entire printing device by adding a secondary media drive system to allow for precision printing at the edge of print media, regardless of the variances in the printing device and/or print media, is time consuming and expensive.

In contrast, initiating a shortage model in accordance with the present disclosure allows for the shortage model to be initiated in a more efficient manner, and thus eliminates the need to modify the entire printing device based on particular variances. As a result of at least some these variances being eliminated, the virtual bottom margin may be reduced (tuned) to deliver a smaller bottom margin without necessitating the addition of a second media drive system.

FIG. 1 illustrates an example system 100 for initiating a shortage model according to the present disclosure. System 100 may include a number of components, as illustrated in FIG. 1. In some examples, system 100 may be a printing device, such as a two dimensional (2D) printer and/or a three dimensional (3D) printer, among other examples. As described herein, in order to minimize the bottom margin of printed data, a proximal end of a nozzle array in the printing device may be utilized when printing the bottom of the data. In other printing devices, the bottom of the print data may be printed with an essentially random section of the nozzle array. As described herein, initiating the shortage model in system 100 may change the usual cadence, e.g., order, of linefeed advances in such a way to align the bottom of the printed data with a proximal end of the nozzle array. Put another way, by initiating a shortage model as described herein, system 100 may align the bottom of a page of printed media with an ink nozzle closest to the bottom of the print media and turn off ink nozzles distal to the bottom of the print media.

System 100 may include a feedshaft 102. As used herein, a feedshaft refers to a device that spans a length of the system 100 and which controls advancement of a page of print media 104. In some examples, the feedshaft 102 may be a cylindrical shaped device, although examples are not so limited and the feedshaft 102 may have a shape other than cylindrical. Further, as used herein, print media 104 refers to any form of surface upon which something may be printed. In some examples, print media 104 may be paper, plastic, and/or composite, among other materials. Put another way, the feedshaft 102 may control advancement of a page of print media 104 in the printing device (e.g., system 100).

Further, as illustrated in FIG. 1, the system 100 may include an upper paper guide 106. As used herein, an upper paper guide refers to an apparatus extending along a surface of the feedshaft 102, which may apply an opposing force upon the feedshaft 102. The upper paper guide 106 may guide the page of print media 104 during advancement through the printing device. For instance, upper paper guide 106 may remain in contact with the page of print media 104 to ensure that the page of print media 104 does not move laterally as it advances through the printing device. Notably, the phrase "upper paper guide" is used herein for ease of understanding, and by no means limits the location of the paper guide 106 to a particular location. While upper paper guide 106 is illustrated above the feedshaft 102, examples are not so limited and the upper paper guide 106 may be located in other places relative to feedshaft 102 while still maintaining an opposing force on the feedshaft 102.

In some examples, the upper paper guide 106 may include a pinch roller 108. As used herein, a pinch roller refers to a component of the upper paper guide which may be in direct contact with the feedshaft 102, and which may apply the opposing force from the upper paper guide 106 onto the feedshaft 102. Put another way, the pinch roller 108 may hold the page of print media 104 in contact with the feedshaft 102 by "pinching", or applying opposing forces on, the print media 104. As illustrated in FIG. 1, the upper paper guide 106 may include a tip 120 that extends past the feedshaft 102. In such a manner, the tip 120 may contact the print media 104 and apply an opposition force against the media control surface 110. Through application of an opposition force against the media control surface 110, tip 120 may prevent the page of print media 104 from moving relative to the media control surface 110. Furthermore, the bottom margin of the page of print media 104 may be maintained by tip 120 having a specific size and location relative to the feedshaft 102. For example, when a printing device needs to reliably print with a 0.5 inch margin, tip 120 may be 0.25 inch in size and be located 0.25 inch away from the feedshaft 102. Tip 120 may further hold the page of print media 104 in place relative to the media control surface 110 once at least a portion of the page of print media 104 is no longer in contact with the feedshaft 102.

In some examples, the system 100 may include a media control surface 110. As used herein, a media control surface 110 refers to a planar surface orthogonal to the feedshaft 102 to hold print media 104 relative to the upper paper guide 106. Put another way, the media control surface 110 may maintain the print media 104 in an orthogonal position relative to the feedshaft 102. The distance allowable between an ink nozzle array 116 and the media pinch point 112 may be limited by the size of the upper paper guide 106 and the size of the ink cartridge 118. Put another way, the bottom margin space on a page of print media 104 may depend on the separation between the ink nozzle array 116 and the media pinch point 112.

The system 100 may further include a processor 114. As described further herein, the processor 114 may perform a number of functions to initiate a shortage model. As used herein, a shortage model refers to instructions which alter an active printing device to prevent data that cannot fit on a page of print media from being printed. For instance, as illustrated in FIG. 1, the system 100 may include a plurality of ink nozzles arranged in an array 116. As used herein, an ink nozzle refers to the portion of an ink cartridge that dispenses ink onto a page of print media. When the processor 114 initiates the shortage model, the shortage model may change the usual cadence of linefeed advances in such a way to align the bottom of the printed data with an ink nozzle proximal to the bottom of the printed data, relative to other ink nozzles in the nozzle array 116. Put another way, when the shortage model is initiated by the processor 114, the bottom of the printed data may be aligned with a proximal ink nozzle in the ink nozzle array 116. In such a manner, ink nozzles in the ink nozzle array 116 which are distal to the pinch point 112 may be turned off, such as by processor 114.

In some examples, the feedshaft 102, the upper paper guide 106, the pinch roller 108, and the media control surface 110 may remain in contact with the print media 104 throughout the initiation and implementation of the shortage model. For instance, the feedshaft 102, upper paper guide 106, the pinch roller 108, and the media control surface 110 may be configured such that the distance between the nozzles and pinch point 112 limits the bottom margin space on the print media 104 to a threshold distance. For example, if a bottom margin of 0.5 inches were established for printing on a particular print media, then the feedshaft 102, upper paper guide 106, the pinch roller 108, and the media control surface 110 may be arranged in such a way that the ink nozzle array 116 could not physically move closer to the pinch point 112 past 0.5 inches, due to the orientation and size of the various parts. By remaining in contact with the print media 104 throughout the initiation and implementation of the shortage model, feedshaft 102, upper paper guide 106, pinch roller 108, and media control surface 110 work together to ensure that the page of print media 104 remains in place such that nozzle array 116 is able to print at a last possible location before the bottom margin.

Figure 2:
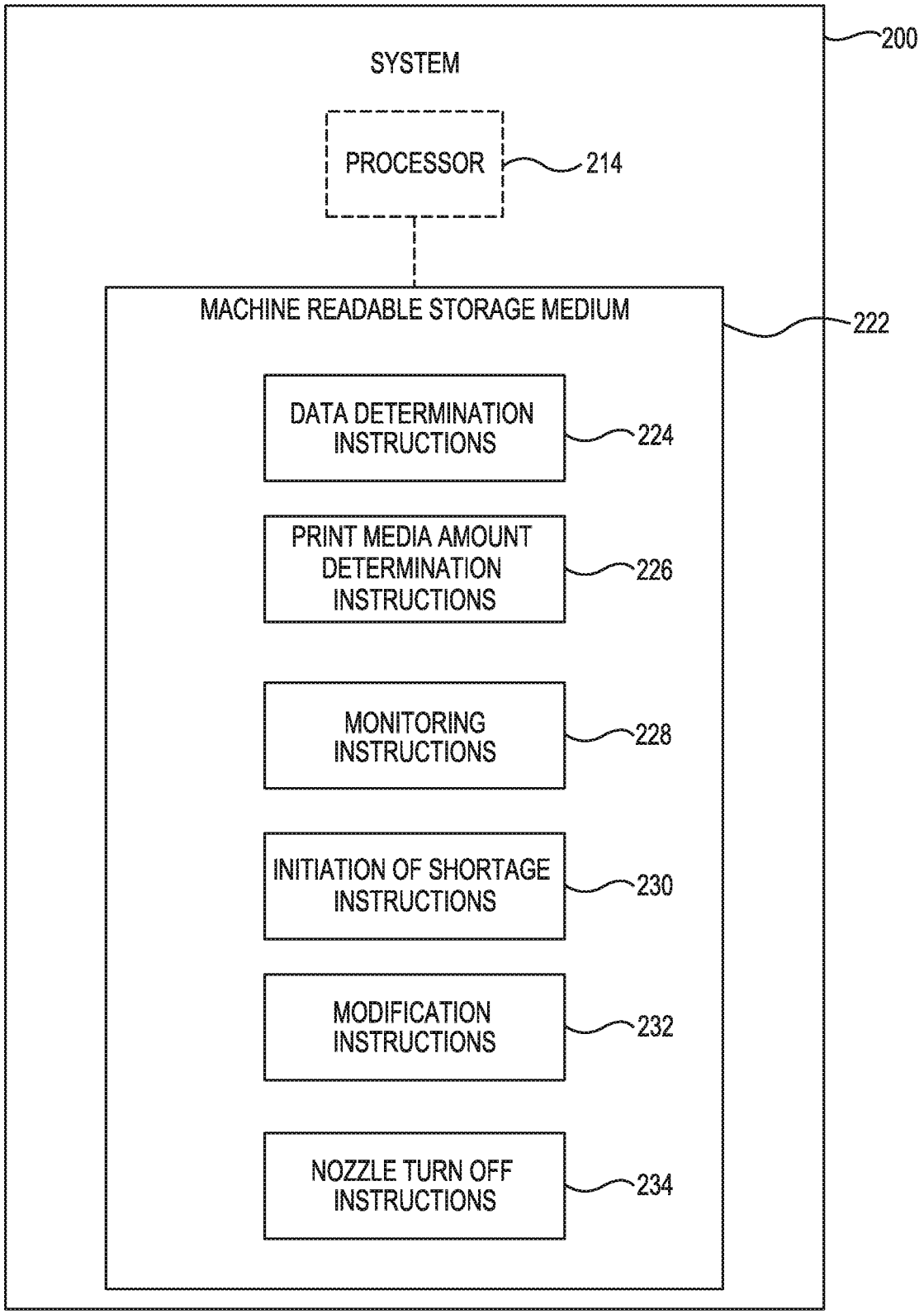
FIG. 2 illustrates an example system for initiating a shortage model according to the present disclosure.

FIG. 2 illustrates an example system 200 for initiating a shortage model according to the present disclosure. System 200 may include at least one computing device that is capable of communicating with at least one remote system. In the example of FIG. 2, system 200 includes a processor 214 and a machine-readable storage medium 222. Although the following descriptions refer to a single processor and a single machine-readable storage medium, the descriptions may also apply to a system with multiple processors and multiple machine-readable storage mediums. In such examples, the instructions may be distributed (e.g., stored) across multiple machine-readable storage mediums and the instructions may be distributed (e.g., executed by) across multiple processors. Processor 214 may be analogous to processor 114 illustrated in FIG. 1.

Processor 214 may be one or more central processing units (CPUs), microprocessors, and/, or other hardware devices suitable for retrieval and execution of instructions stored in machine-readable storage medium 222. In the particular example shown in FIG. 2, processor 214 may receive, determine, and send instructions 224, 226, 228, 230, 232, and 234 for initiating a shortage model. As an alternative or in addition to retrieving and executing instructions, processor 214 may include one or more electronic circuits comprising a number of electronic components for performing the functionality of one or more of the instructions in machine-readable storage medium 222. With respect to the executable instruction representations (e.g., boxes) described and shown herein, it should be understood that part or all of the executable instructions and/or electronic circuits included within one box may, in alternate examples, be included in a different box shown in the figures or in a different box not shown.

Machine-readable storage medium 222 may be any electronic, magnetic, optical, or other physical storage device that stores executable instructions. Thus, machine-readable storage medium 222 may be, for example, Random Access Memory (RAM), an Electrically-Erasable Programmable Read-Only Memory (EEPROM), a storage drive, an optical disc, and the like. Machine-readable storage medium 222 may be disposed within system 200, as shown in FIG. 2. In this situation, the executable instructions may be "installed" on the system 200. Additionally and/or alternatively, machine-readable storage medium 222 may be a portable, external or remote storage medium, for example, that allows system 200 to download the instructions from the portable/external/remote storage medium. In this situation, the executable instructions may be part of an "installation package". As described herein, machine-readable storage medium 22 may be encoded with executable instructions for monitoring network utilization.

Referring to FIG. 2, data determination instructions 224, when executed by a processor, such as processor 214, may cause system 200 to determine an amount of data to be printed by a printing device based on a received print job. For example, data determination instructions 214 may instruct the system 200 to look at the size of a file to be printed in order to determine an amount of data to be printed. Data determination instructions 214 may further instruct the system 200 to determine how data to be printed maps to ink nozzles on the nozzle array based on a particular linefeed advance length.

Data alignment instructions 226, when executed by a processor, such as processor 214, may cause system 200 to align the bottom of a page of data with the bottom margin of the page of print media. Put another way, data alignment instructions 226 may set the data to print to the extent of the bottom margin. For example, if a page of data requires a 0.5 inch margin, data alignment instructions 226 may align the last row of print data with the 0.5 inch margin such that the full page of data may print onto a page of print media.

Monitoring instructions 228, when executed by a processor, such as processor 214, may cause system 200 to monitor print media motion during printing. For instance, referring to FIG. 1, the processor 214 may monitor the motion of the print media 104 relative to the feedshaft 102. As discussed further herein, the processor 214 may initiate a shortage model once the print media 104 is within a threshold distance of the pinch point 112.

Shortage model initiation instructions 230, when executed by a processor, such as processor 214, may cause system 200 to initiate a shortage model. Initiation of a shortage model according to initiation instructions 230 may depend on the amount of data determined in data determination instructions 224 or on the amount of print media determined in print media determination instructions 226. In other words, shortage model initiation instructions 230 may trigger based on prior determinations made by processor 214. Shortage model initiation instructions may further trigger when print media 104, as shown in FIG. 1, is within a threshold distance of pinch point 112, also shown in FIG. 1.

Modification instructions 232, when executed by a processor, such as processor 214, may cause system 200 to modify the motion of the print media. Modification instructions 232 may use the shortage model to determine how the print media motion should be modified. For instance, modification instructions 232 may modify the motion of the print media such that the bottom of the page of print media may be aligned with the nozzles proximal to the feedshaft. Modification instructions 232 may further change the usual cadence of the linefeed advances such that the bottom of the printed data becomes mapped to and will thus align with an ink nozzle proximal thereto.

Figure 3:
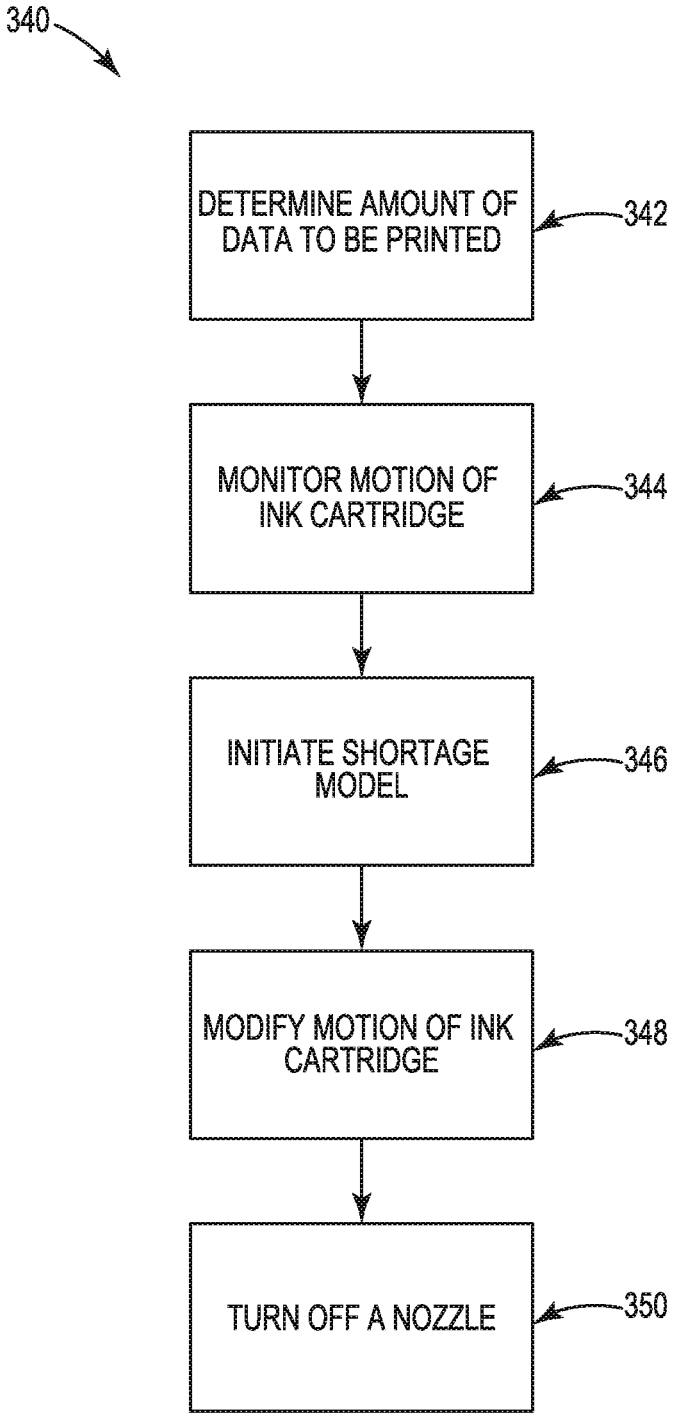
FIG. 3 illustrates an example method for initiating a shortage model according to the present disclosure.

Nozzle turn off instructions 234, when executed by a processor, such as processor 214, may cause system 200 to turn off a nozzle housed on the ink cartridge. The shortage model may determine which nozzle to turn off. The turned off nozzle may be located at the distal end of the nozzle array relative to the bottom of the page of print media. Nozzle turn off instructions 234 may further turn off a nozzle which is not mapped to data to be printed after modification instructions 234 modify the motion of the page of print media FIG. 3 illustrates an example method 340 for initiating a shortage model according to the present disclosure. At 342, method 340 may include determining an amount of data to be printed by a printing device. The determination of the amount of data to be printed 342 may be based on a print job received by the printing device.

At 344, method 340 may include monitoring the relative motion of the ink cartridge and the print media. As used herein, relative motion refers to the motion of the ink cartridge relative to the print media. For instance, referring to FIG. 1, the motion of the ink cartridge 118 relative to the pinch point 112 may be monitored. Monitoring the motion of the ink cartridge 344 may include, for example, monitoring the separation between the ink cartridge 118 and the pinch point 112, depicted in FIG. 1, to ensure that a threshold distance is maintained.

At 346, method 340 may include initiating a shortage model. The shortage model may be triggered by the end of the print data itself, as determined at 342. Further, the shortage model may be triggered by ink cartridge 118 and pinch point 112, depicted in FIG. 1, coming within a threshold distance of one another.

At 348, method 340 may include modifying the relative motion of the ink cartridge. The relative motion may be modified based on the initiation of a shortage model at 346. For example, the sweep pattern of the ink cartridge may be modified in such a way to align the bottom of the printed data with an ink nozzle proximal bottom of the page of print media, relative to other ink nozzles in the nozzle array. The shortage model may further modify the usual cadence of linefeed advances such that the bottom of the printed data may align with an ink nozzle proximal to the bottom of the printed data relative to other ink nozzles in the nozzle array.

At 350, method 340 may include turning off a nozzle on the ink cartridge. The nozzle to be turned off may be based on the shortage model initiated at 346. For instance, the nozzle turned off may be located on the end of the ink nozzle array distal to the bottom of the print media.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. As used herein, the designators "N", "M", "P", "Q", "R", "S", and "T" particularly with respect to reference numerals in the drawings, indicate that a number of the particular feature so designated can be included with examples of the present disclosure. The designators can represent the same or different numbers of the particular features. Further, as used herein, "a number of" an element and/or feature can refer to one or more of such elements and/or features.

As used herein, "logic" is an alternative or additional processing resource to perform a particular action and/or function, etc., described herein, which includes hardware, e.g., various forms of transistor logic, application specific integrated circuits (ASICs), etc., as opposed to computer executable instructions, e.g., software firmware, etc., stored in memory and executable by a processor.

What is claimed:

1. A printing device to initiate a shortage model, comprising:

an ink nozzle array;

a media control surface;

a processor, and a memory storing non-transitory machine readable instructions to cause the processor to:

initiate a shortage model to limit printing on a print media; and cause a particular ink nozzle of the ink nozzle array to turn off based on the initiation of the shortage model.

2. The printing device of claim 1, including instructions to cause the processor to initiate the shortage model to limit printing on the print media in response to a length of the print media not matching an amount of data to be printed by the printing device.

3. The printing device of claim 2, including instructions to cause the processor to initiate the shortage model to turn off a nozzle of the ink nozzle array distal to the print media in response to the length of the print media not matching the amount of data to be printed by the printing device.

4. The printing device of claim 1, including instructions to cause the processor to align a bottom of the print media with a particular nozzle of the ink nozzle array.

5. The printing device of claim 1, including instructions to cause the processor to align a bottom of the print media with g particular nozzle of the ink nozzle array by modifying linefeed advances.

6. The printing device of claim 1, wherein the printing device includes a feedshaft to control advancement of the print media in the printing device.

7. The printing device of claim 6, wherein the printing device includes a paper guide including a pinch roller to guide the print media during advancement of the print media through the printing device.

8. The printing device of claim 7, including instructions to cause the processor to initiate the shortage model to limit printing on the print media in response to an edge of the print media being within a threshold distance of a pinch point between the pinch roller and the feedshaft of the printing device.

9. The printing device of claim 7, wherein the media control surface holds the print media in place relative to the paper guide of the printing device.

10. The printing device of claim 7, wherein the paper guide includes a tip extending past the feedshaft.

11. The printing device of claim 10, wherein the tip contacts the print media and applies an opposition force against the media control surface.

12. A non-transitory computer-readable medium containing instructions executable by a processor to cause the processor to:

determine an amount of data to be printed on a print media by a printing device;

initiate a shortage model to limit printing on the print media in response to:

a length of the print media not matching the amount of data to be printed; or an edge of the print media being within a threshold distance of a pinch point between a pinch roller and a feedshaft of the printing device; and turn off a particular nozzle of an ink nozzle array of the computing device in response to initiation of the shortage model.

13. The non-transitory computer readable medium of claim 12, wherein the instructions are further executable to cause the processor to map the amount of data to be printed to ink nozzles included on an ink nozzle array of the printing device based on a particular linefeed advance length.

14. The non-transitory computer readable medium of claim 12, wherein the instructions are further executable to cause the processor to turn off a nozzle of an ink nozzle array of the printing device distal to the print media.

15. The non-transitory computer readable medium of claim 12, wherein the instructions are further executable to cause the processor to turn off a nozzle of an ink nozzle array of the printing device which is not mapped to data to be printed.

16. A method, comprising:

determining, by a processor of a printing device, an amount of data to be printed on a print media by the printing device;

monitoring, by the processor, motion of:

the print media through the printing device; and an ink nozzle array of the printing device relative to the print media;

initiating, by the processor, a shortage model to limit printing on the print media;

modifying, by the processor, motion of the print media based on the initiation of a shortage model to:

align a bottom of the data to be printed on the print media with a particular ink nozzle of the ink nozzle array; or align the particular ink nozzle of the ink nozzle array with a bottom of the print media; and turning off, by the processor, an ink nozzle of the ink nozzle array in response to the initiation of the shortage model.

17. The method of claim 16, wherein the method includes initiating the shortage model to limit printing on the print media in response to a length of the print media not matching the amount of data to be printed.

18. The method of claim 16, wherein the method includes initiating the shortage model to limit printing on the print media in response to an edge of the print media being within a threshold distance of a pinch point between a pinch roller and a feedshaft of the printing device.

19. The method of claim 18, wherein the method includes initiating the shortage model in response to the print media triggering a mechanical switch when the print media moves to within the threshold distance of the pinch point.

20. The method of claim 16, wherein the method includes turning off the ink nozzle of the ink nozzle array wherein the ink nozzle is located proximal to a feedshaft controlling motion of the print media through the printing device.

* * * * *